US005647210A

United States Patent [19]

Gustafsson

[11] Patent Number: 5,647,210

[45] Date of Patent: Jul. 15, 1997

[54] DRIVING DEVICE

[76] Inventor: Leif Gustafsson, Snapphanevägen 6, Holmsjö , Sweden, S-370 34

[21] Appl. No.: 500,965

[22] PCT Filed: Jan. 21, 1994

[86] PCT No.: PCT/SE94/00041

§ 371 Date: Jul. 25, 1995

§ 102(e) Date: Jul. 25, 1995

[87] PCT Pub. No.: WO94/17311

PCT Pub. Date: Aug. 4, 1994

[30] Foreign Application Priority Data

Jan. 28, 1993 [SE] Sweden ..... 9300253

[51] Int. Cl.[6] ..... F16D 31/02; F15B 13/02

[52] U.S. Cl. ..... 60/477; 91/3; 417/186

[58] Field of Search ..... 91/3, 47; 60/477; 417/182, 186, 187; 137/861, 887, 888

[56] References Cited

U.S. PATENT DOCUMENTS

| | | | |
|---|---|---|---|
| 3,122,039 | 2/1964 | Sowers, III | 91/3 X |
| 3,234,934 | 2/1966 | Woodward | 91/3 X |

FOREIGN PATENT DOCUMENTS

| | | | |
|---|---|---|---|
| 0 051 853 A1 | 5/1982 | European Pat. Off. . | |
| 405451 | 8/1943 | France | 60/477 |
| 46-11685 | 3/1971 | Japan | 91/443 |
| 570487 | 7/1945 | United Kingdom | 91/47 |
| WO92/11980 | 7/1992 | WIPO . | |

OTHER PUBLICATIONS

Derwent's Abstract, No. 91-279891/38, week 9138, Abstract of Su, 1603081 (Sheremet P Z) 30 Oct. 1990.

*Primary Examiner*—Hoang Nguyen

*Attorney, Agent, or Firm*—Zarley, McKee, Thomte, Voorhees, & Sease

[57] ABSTRACT

A driving device comprises a source of hydraulic fluid under pressure, a working arrangement (6) having a working chamber (7) intended for receiving hydraulic fluid and a working member (8) adapted to be put in motion on respective fluid supply to and fluid evacuation from the working chamber. Conduits (20, 29, 30) are provided for respective supply to and evacuation from the working chamber (7) of hydraulic fluid. A valve (16) is adapted to, in a first state, direct fluid to the working chamber and, in a second state, allow evacuation of fluid from the working chamber. An apparatus (17) are provided for returning the working member to a starting position. These apparatus comprise an ejector arrangement adapted to generate a negative pressure evacuating the working chamber as a consequence of flow of fluid through the ejector arrangement. The hydraulic fluid source is constituted by a high pressure washing unit known per se or of an arbitrary nature.

21 Claims, 3 Drawing Sheets

DRIVING DEVICE

This application is a Rule 371 of PCT/SE94/00041, filed on Jan. 21, 1994.

FIELD OF THE INVENTION AND PRIOR ART

This invention is related to a driving device according to the precharacterizing parts of the appending FIGS. 1–3. The driving device according to the invention may be used in any conceivable connections where it is desired to put a working member in motion. Although it can be mentioned as an example that the working arrangement could form a part of machines for splitting wood pieces, more specifically so called fire wood cleaving machines, it can be mentioned as other examples on applications general use as jacks, presses, bending apparatus etc, the working member of course being provided with an arbitrary tool for carrying out the function aimed at.

Fire wood cleaving machines of the kind mentioned in the introduction are known per se. By way of example, reference can be made to WO 92/11 980 (PCT/SE 91/00914), the European patent publication No. 0 051 853, the Swedish publication for inspection No. 7904914-4 (416 903) and the Swedish publication for inspection No. 8304029-5 (453 898).

The two first mentioned publications are particularly interesting in the present connection. The devices more closely described therein suffer from several important disadvantages. One of these disadvantages resides in the need for springs for returning the working member to a starting position, these springs having to be tensioned during the working stroke. Such springs tend to become fatigued with time, which requires exchange of springs. Furthermore, power for tensioning the springs is required during the working stroke, which increases the total power requirement of the working arrangement. Besides it should be pointed out that the need for such springs makes the embodiment complicated and necessitates also as a rule, at least in more simple embodiments, need for an increased length of the working arrangement. Finally, the work in connection with mounting and replacement of such springs is risky since the springs must be applied with some pretensioning.

Another disadvantage with the prior art is that the costs for the driving devices tend to be relatively high. In WO 92/11980 it is intended to use an internal combustion engine combined with a hydraulic pump of the kind normally appearing in hydraulic drive applications. In the European patent publication 0 051 853 it is suggested to use a part of a portable power saw and to combine this power saw part with a hydraulic pump. Such power saws are normally rather costly and will in this intended application require a specially manufactured hydraulic pump or at least a specially manufactured coupling part. Usage of the power saw part for its regular purpose requires dismounting of the hydraulic pump and application of power saw sword, chain etc.

SUMMARY OF THE INVENTION

The present invention aims at reducing the disadvantages discussed hereinabove.

According to a first aspect of the concept of the invention it is intended to provide ways to design the means for returning the working chamber to a starting position without one having to rely on springs or similar elements based upon power accumulation. This aspect of the invention is fulfilled by that primarily shown in FIGS. 1–3, namely an ejector arrangement adapted to achieve evacuation of the working chamber and thereby returning of the working member by creating a negative pressure in the working chamber.

According to a second aspect of the invention it is aimed at providing ways to reduce, to a minimum, the cost of the hydraulic fluid source, the latter at the same time being adapted to easily be used for alternative purposes without requiring substantial dismounting or mounting work. Essential in this connection is, furthermore, that the: hydraulic fluid source aimed at should be relatively widely spread and be possible to purchase at a reasonable price.

This second aspect of the invention is fulfilled by the hydraulic fluid source being constituted by a high pressure washing unit known per se or of an arbitrary nature. In that way a relatively non expensive unit is used as the hydraulic fluid source, said unit having a valuable alternative use after an easily executable decoupling of conduits by means of suitable quick couplings. Essential for this aspect of the invention is, as is shown in the figures, that a fluid circulation is formed so that the fluid used, normally water, always circulates in the circulation when the working member is passive. When the working member is to be activated, the valve will, as a consequence of that shown in the figures, divert the entire or a part of the flow of the circulation towards the working chamber. In order to avoid detrimental overpressure conditions it is suitable to provide, as shown in the figures, a pressure restriction valve. Other advantages and features of the construction according to the invention appear more closely by the following description and the rest of the claims.

BRIEF DESCRIPTION OF THE DRAWINGS

With reference to the enclosed drawings a more specific description of an embodiment example of the invention is presented hereunder.

In the drawings

DETAILED DESCRIPTION OF A PREFERRED EMBODIMENT

Figure 1:
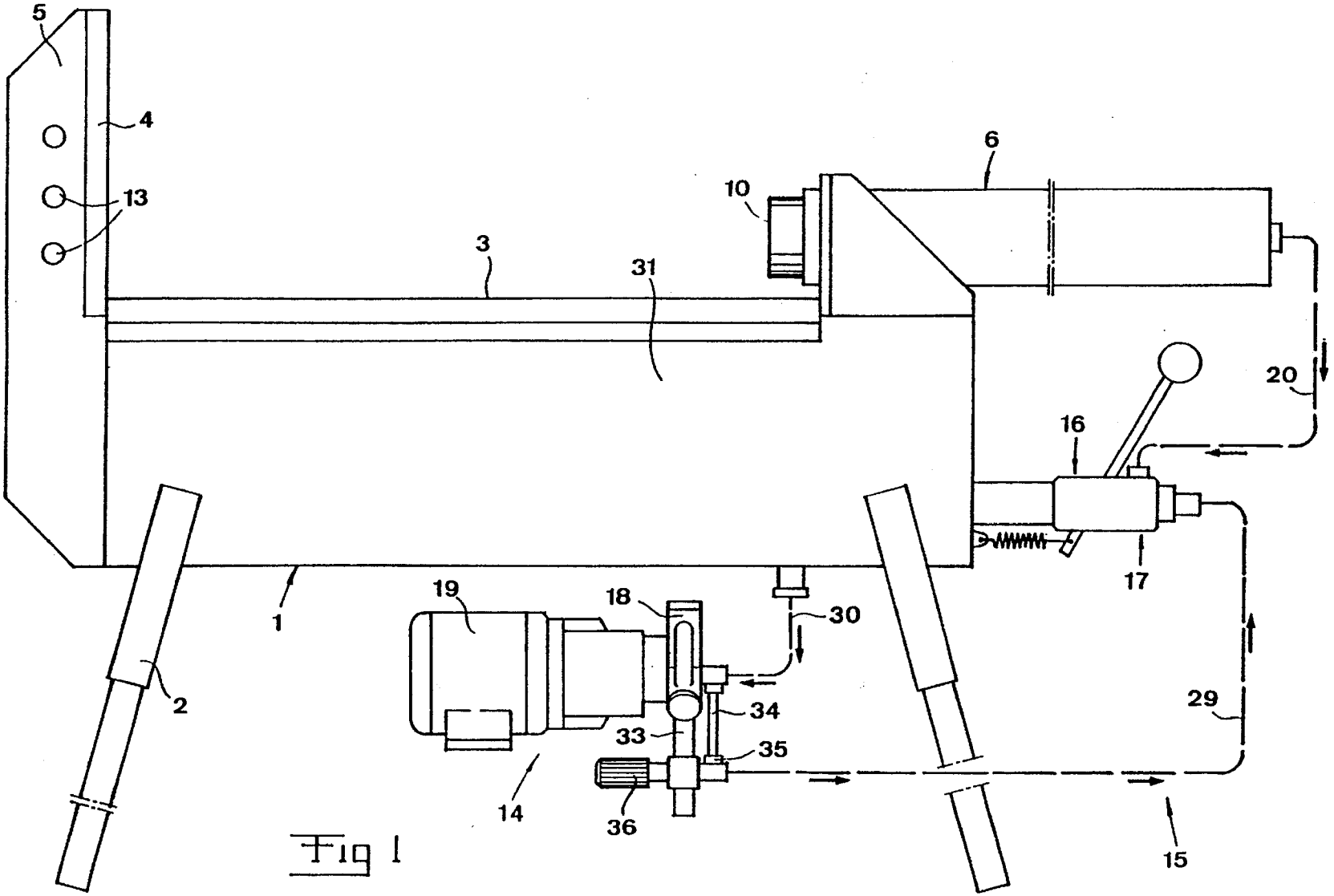
FIG. 1 is a diagrammatical side view of the driving device according to the invention applied on a fire wood cleaving machine.

The fire wood cleaving machine illustrated in the drawings comprises a base generally denoted 1 and being adapted to be supported relative to the underlayer by means of suitable supports or legs 2.

The base 1 comprises at its upper part a support surface 3 for receiving wood pieces. This surface may for instance be cross sectionally V- or U-shaped in Order to form a seat for the wood pieces. At one end of the support surface there is arranged on the base 1 at least one edge member 4. This edge member 4 protrudes upwardly above the support surface 3 and may be arranged on a bracket like holder 5. At the other end of the support surface 3 a working arrangement 6 is provided. This has (see FIG. 3) a working chamber 7 intended for receiving hydraulic fluid and a working member 8 adapted to be put in motion on respective fluid supply to and fluid evacuation from the working chamber 7. A basic part 9 of the working arrangement 6 is rigidly connected to the base 1. The working member 8 is adapted to move relative to this basic part 9. The working member 8 comprises, preferably, a particular contact member 10 adapted to contact the wood piece.

In the example the working arrangement has the character of a hydraulic cylinder, the cylinder being formed by the basic part 9 and the piston of the working member 8. The contact member 10 is arranged at the extreme end of the piston rod 11 of the piston 8.

Figure 2:
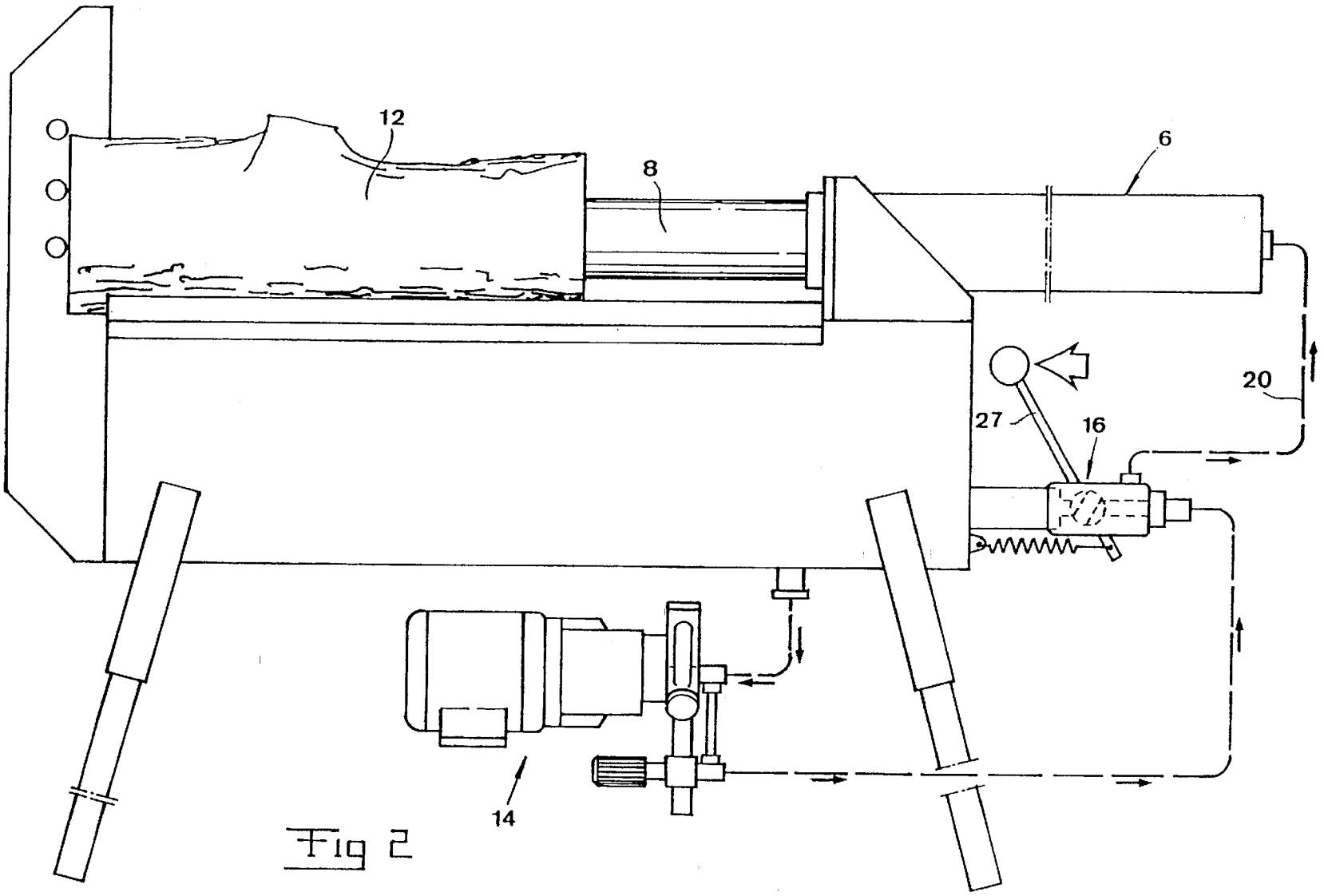
FIG. 2 is a view similar to FIG. 1 but illustrating a state of operation.

When the piston 8 is caused to move relative to the cylinder 9, the contact member 10 will hit a wood piece denoted 12 in FIG. 2 and force the same to move relative to the fixed edge member 4 so that a cleavage function occurs.

In case it would be desired to be able to use the device described for other pressing or power application purposes than fire wood cleaving per se, there may be on the base 1 fixing means 13, e.g. fixing holes, for securing particular dollies or other auxiliary equipment intended for specific work purposes, said equipment being intended to function in co-operation with the power generating working arrangement 6.

Figure 3:
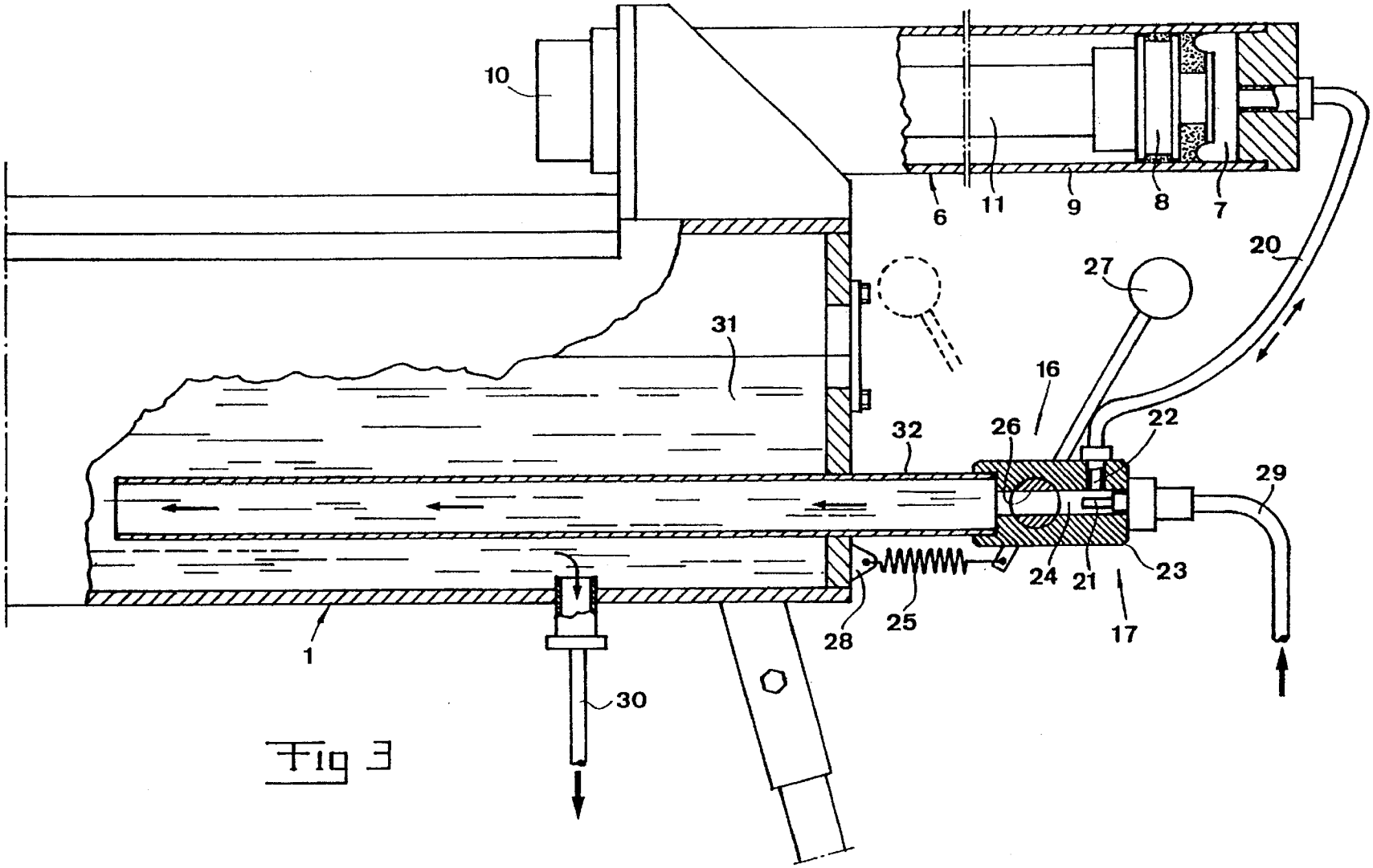
FIG. 3 is a partly cut and enlarged view illustrating parts of the fire wood cleaving machine and the driving device according to the invention.

The driving device according to the invention comprises a source 14 of hydraulic fluid under pressure. Conduits collectively designated 15 are provided for respective supply to and evacuation from the working chamber 7 of hydraulic fluid. A valve 16 is adapted to, in a first state (FIG. 2), direct fluid to the working chamber 7 and, in a second state (FIGS. 1 and 3), allow evacuation of fluid from the working chamber. Means 17 are provided for returning the working member 8 to a starting position (FIGS. 1 and 3).

The returning means 17 comprises an ejector arrangement adapted to generate a negative pressure in the working chamber 7 for evacuating the same as a consequence of flow of fluid through the ejector arrangement.

The hydraulic fluid source 14 comprises a pump 18 and a motor 19 driving the same, suitably an electric motor even if also other types of motors, e.g. internal combustion engines, may be in question.

The pump 18 of the hydraulic fluid source 14, the conduits 15, more specifically parts of these conduits, and the valve 16, when it is in its second state; (FIGS. 1 and 3), define a fluid circulation, in which the ejector arrangement 17 is provided, there being a connection 20 between the ejector arrangement 17 and the working chamber 7. In the example this connection 20 has the character of a conduit of a certain length but it should be noted that the connection 20 in practice could be extremely short, namely in case the ejector arrangement 17 would be provided close to or integrated with the working arrangement 6.

The ejector arrangement 17 comprises at least one nozzle 21 arranged to, when the valve 16 is in its second state (FIGS. 1 and 3), cause the fluid to flow in such a way relative to an adjacent portion 22 of the connection that a negative pressure occurs in the connection. The ejector arrangement 17 is in the example provided in a piece 23. The nozzle 21 extends substantially axially relative to a passage 24 in the piece 23, whereas the adjacent portion 22 of the connection 20 opens into the passage 24 through its side, i.e. the mouth of the portion 22 is directed at an angle, suitably a substantially right angle, to the direction of the nozzle 21.

The valve 16 is in the embodiment provided downstream the ejector nozzle 21 in the circulation. Resilient means 25 in the form of one or more springs are provided to actuate the valve 16 to a normal position, which is formed by the second state (FIG. 3).

In the embodiment it is illustrated that the valve 16 comprises a movable valve body 26, which in the first state entirely or partially closes or contracts the flow of fluid in the circulation and thereby forces fluid to flow to the working chamber 7 via the nozzle 21, the passage 24, the mouth portion 22 and the connection 20. This state of the valve is indicated in FIG. 2. In the second state (FIG. 3) the valve body 26 opens the circulation practically entirely, the fluid flowing through the ejector nozzle 21 applying, via the connection 20, a negative pressure in the working chamber 7, which involves evacuation thereof.

In the example the valve body 26 is rotatably movable and provided with a through opening, which by rotation of the valve body is caused to allow flow of fluid through the opening or close against flow therethrough.

In the example it is illustrated that the valve body 26 is arranged in the same piece 23 which also comprises the ejector arrangement 17. Thus, rotation of the valve body 26 gives rise to closing and opening respectively of the passage 24 through the piece 23.

It is preferred that the valve body 26 is co-ordinated with a handle 27 or other suitable operating member, the purpose of which is to primarily manually operate the valve body 26. The actuation means 25 has, in the example, the character of a spring acting between the operating member 27 and a bracket 28 on the base 1. The purpose: therewith is that the valve body 26 automatically should return to its second state (FIG. 3) when the operating member 27 is released.

Thus, the circulation described comprises the pump 18, the passage 24 and the ejector nozzle 21 provided therein and the valve body 26 and a conduit section 29 between the pump 18 and the ejector arrangement 17 and a second conduit section 30 extending between the valve 16 and pump 18.

Besides, a hydraulic fluid tank 31 is arranged in the circulation. The working arrangement 6 is secured to the base 1 and a hollow part of this base forms the tank 31. In the example the conduit section 30 is connected to the tank 31 with its end turned away from the pump 18, whereas the valve 16 via a conduit section 32 communicates with the interior of the tank 31. The conduit section 32 is conceived to have a rigid design and extends into the tank 31 so as to act as a turbulence damper therein.

The conduit section 30 from the tank 31 is connected to the suction side of the pump 18. The pressure side of the pump delivers at 33 high pressure fluid to the conduit section 29. In a connection 34 between the pressure side and suction side of the pump there is provided a valve 35 opening on exceeding of a certain pressure on the pressure side. This opening point is suitably adjustable by means of an operating member 36. The valve 35 is formed by a conventional non-return valve. The purpose of the valve 35 is to ensure flow of fluid through the pump 18 also when the valve 16 is closed and the working chamber 7 at a maximum. The connection 34 could of course also extend between the conduit section 29 and the interior of the tank 31 so that the pump would deliver, with open valve 35, pressure fluid via the connection 34 into the tank 31, from which fluid would be sucked into the pump on its suction side.

The hydraulic fluid source 14 is formed by a high pressure washing unit known per se or of an arbitrary nature. Such units are accessible on the market at reasonable price and have surprisingly turned out to be operable extremely well as a power source for the driving device according to the invention as a consequence of the design thereof such that a circulation of fluid through the pump 18 of the high pressure washing unit is maintained under all normal conditions. It should be pointed out here that the fluid volume of the tank 31 should be at least as large as the maximum volume of the working chamber 7 so that there is always liquid in the tank 31 when the working chamber 7 is expanded to a maximum degree.

The high pressure washing unit 14 is very easily connectable to the conduit sections 29, 30 with conventional quick couplings. When the high pressure washing unit shall no longer be used as a power source in the driving device, it is easily decoupled from the conduit sections 29 and 30 and instead the suction side of the pump 18 is coupled to the water supply network and its pressure side to a suitable spray nozzle.

When using the driving device according to the invention, the valve 16 is in the position according to FIG. 3 as long as the working member 8 is inactive. The pump 18 then delivers fluid to the conduit section 29 at its pressure side and fluid flows in the previously described circulation through the ejector device 17 and the valve 16 into the tank 31 and then via the conduit section 30 to the suction side of the pump 18. Since the valve 16 is open, there is no risk for overheating of the pump 18. When the working member 8 is to be displaced, the operator operates the valve 16 so that its valve body 26 entirely or partially closes the flow past the valve. This means that the fluid pressure via the connection 20 is propagated to the working chamber 7 with associated fluid flow into the same and the working member 8 is displaced while the working chamber is expanded. During this expansion the pump 18 delivers pressure fluid through the conduit sections 29, 20 whereas the pump on its suction side obtains fluid from the tank 31. When the working member 8 reaches its end position and the working chamber 7 is at its maximum, the fluid ceases to flow into the same. If the operator then does not release the valve 16 for opening, the fluid ceases to flow on the pressure side of the pump 18, which causes a pressure increase, which upon reaching of a certain level causes the non-return valve 35 to open so that fluid from the high pressure side of the pump flows over to the suction side, whereby flow via the pump is always ensured.

When the valve 16 is allowed to return to the position according to FIG. 3 by the operator, a fluid flow again occurs in the circulation described. Fluid will then via the ejector nozzle 21 pass the adjacent mouth 22 of the connection 20 so that a fluid evacuating negative pressure occurs in the connection and the working chamber 7. This negative pressure causes the working member or piston 8 to return to its starting position while reducing the volume of the working chamber 7. Thus, the normal position of the device in its inactive state is such that the valve 16 is then open and the ejector arrangement 17 always ensures via the connection 20 a negative pressure tending to retain the working member 8 in its starting position with the working chamber 7 at its minimum.

The invention described can of course be modified in several ways within the scope of the invention. As already pointed out, the driving device according to the invention does not necessarily have to be applied in the form of a fire wood cleaving machine or similar but quite different applications may be in question. As far as the use of a high pressure washing unit as a hydraulic fluid source is concerned, it is here pointed out that a portable unit is primarily intended. In relation to the ejector arrangement 17 it is pointed out that the mouth of the portion 22 of the connection 20 could of course also be directed substantially in parallel to the discharge direction from the nozzle 21. What is important with the invention in this regard is that the nozzle 21 and the portion 22 of the connection 20 should be so mutually related that when fluid flows out through the nozzle 21 a negative pressure is created in the connection 20 and the working chamber 7, this of course presuming that the flow way downstream the nozzle is not blocked.

I claim:

1. A driving device comprising a source (14) of hydraulic fluid under pressure, a working arrangement (6) having a working chamber (7) intended for receiving hydraulic fluid and a working member (8) adapted to be put into motion on respective fluid supply to and fluid evacuation from the working chamber, at least one conduit for respective supply to and evacuation from the working chamber of hydraulic fluid, a valve (16) adapted to, in a first state, direct fluid to the working chamber and, in a second state, allow evacuation of fluid from the working chamber, and means (17) for returning the working chamber to a starting position, characterized in that the returning means (17) comprises an ejector arrangement adapted to generate a negative pressure in the working chamber (7) for evacuating the same as a consequence of flow of fluid through the ejector arrangement and there are resilient means (25) for actuating the valve to a normal position, which is constituted by the second state.

2. A driving device according to claim 1, characterized in that the hydraulic fluid source (14), which comprises a pump (18), the at lease one conduit and the valve (16), when it is in its second state, defines a fluid circulation, in which the ejector arrangement (17) is provided, there being a connection (20) between the ejector arrangement and the working chamber (7).

3. A driving device according to claim 2, characterized in that the ejector arrangement (17) comprises at least one nozzle (21) adapted to, when the valve is in its second state, cause fluid to flow such relative to an adjacent portion (22) of the connection (20) that a negative pressure occurs in the connection.

4. A driving device according to claim 3, characterized in that the valve (16) is provided downstream the ejector nozzle (21) in the circulation.

5. A driving device according to claim 4, characterized in that the working arrangement (6) forms a part of a machine for splitting wood pieces, the working member (8) comprising a contact member (10) adapted to contact wood pieces and force the same to move relative to a fixed edge member (4).

6. A driving device according to claim 2, characterized in that the valve (16) is adapted, in its first state, to close or reduce flow in the circulation and instead direct fluid under pressure to the working chamber (7).

7. A driving device according to claim 2, characterized in that a hydraulic fluid tank (31) is arranged in the circulation.

8. A driving device according to claim 7, characterized in that the working arrangement (6) is secured to a base (1) and that a hollow part of the base forms said tank (31).

9. A driving device according to claim 2, characterized in that a valve (35) opening on exceeding of a certain pressure on the pressure side is arranged in the connection (34) between the pressure side and suction side of the pump.

10. A driving device according to claim 1, characterized in that the hydraulic fluid source (14) is constituted by a high pressure washing unit.

11. A driving device comprising a source (14) of hydraulic fluid under pressure, a working arrangement (6) having a working chamber (7) intended for reception of hydraulic fluid and a working member (8) adapted to be put into motion on respective fluid supply to and fluid evacuation from the working chamber, at least one conduit for respective supply to and evacuation from the working chamber of hydraulic fluid, and a valve (16) adapted to, in a first state, direct fluid to the working chamber and, in a second state, allow evacuation of fluid from the working chamber, characterized in that the hydraulic fluid source (14) is constituted by a high pressure washing unit.

12. A driving device according to claim 11, characterized in that a pump (18) included in the high pressure washing unit, the at lease one conduit and the valve (16), when it is in its second state, defines a fluid circulation.

13. A driving device according to claim 12, characterized in that the valve (16) is adapted, in its first state, to close or reduce flow in the circulation and instead direct fluid under pressure to the working chamber (7).

14. A driving device according to claim 12, characterized in that a hydraulic fluid tank (31) is arranged in the circulation.

15. A driving device according to claim 14, characterized in that the working arrangement (6) is secured to a base (1) and that a hollow part of the base forms said tank (31).

16. A driving device according to claim 12, characterized in that a valve (35) opening on exceeding of a certain pressure on the pressure side is arranged in the connection (34) between the pressure side and suction side of the pump.

17. A driving device according to claim 11, characterized in that the working arrangement (6) forms a part of a machine for splitting wood pieces, the working member (8) comprising a contact member (10) adapted to contact wood pieces and force the same to move relative to a fixed edge member (4).

18. A driving device comprising a source (14) of hydraulic fluid under pressure, a working arrangement (6) having a working chamber (7) intended for receiving hydraulic fluid and a working member (8) adapted to be put into motion on respective fluid supply to and fluid evacuation from the working chamber, at least one conduit for respective supply to and evacuation from the working chamber of hydraulic fluid, a valve (16) adapted to, in a first state, direct fluid to the working chamber and, in a second state, allow evacuation of fluid from the working chamber, and means (17) for returning the working chamber to a starting position, characterized in that the returning means (17) comprises an ejector arrangement adapted to generate a negative pressure in the working chamber (7) for evacuating the same as a consequence of flow of fluid through the ejector arrangement, and the hydraulic fluid source (14) is constituted by a high pressure washing unit.

19. A driving device according to claim 18, characterized in that there are resilient means (25) for actuating the valve to a normal position, which is constituted by the second state.

20. A driving device comprising a source (14) of hydraulic fluid under pressure, a working arrangement (6) having a working chamber (7) intended for receiving hydraulic fluid and a working member (8) adapted to be put into motion on respective fluid supply to and fluid evacuation from the working chamber, at least one conduit for respective supply to and evacuation from the working chamber of hydraulic fluid, a valve (16) adapted to, in a first state, direct fluid to the working chamber and, in a second state, allow evacuation of fluid from the working chamber, and means (17) for returning the working chamber to a starting position, characterized in that the returning means (17) comprises an ejector arrangement adapted to generate a negative pressure in the working chamber (7) for evacuating the same as a consequence of flow of fluid through the ejector arrangement and that the hydraulic fluid source (14), which comprises a pump (18), the at least one conduit and the valve (16), when it is in its second state, defines a fluid circulation, in which the ejector arrangement (17) is provided, there being a connection (20) between the ejector arrangement and the working chamber (7), wherein the ejector arrangement (17) comprises at least one nozzle (21) adapted to, when the valve is in its second state, cause fluid to flow such relative to an adjacent portion (22) of the connection (20) that a negative pressure occurs in the connection.

21. A driving device comprising a source (14) of hydraulic fluid under pressure, a working arrangement (6) having a working chamber (7) intended for receiving hydraulic fluid and a working member (8) adapted to be put into motion on respective fluid supply to and fluid evacuation from the working chamber, at least one conduit for respective supply to and evacuation from the working chamber of hydraulic fluid, a valve (16) adapted to, in a first state, direct fluid to the working chamber and, in a second state, allow evacuation of fluid from the working chamber, and means (17) for returning the working chamber to a starting position, characterized in that the returning means (17) comprises an ejector arrangement adapted to generate a negative pressure in the working chamber (7) for evacuating the same as a consequence of flow of fluid through the ejector arrangement, and that the hydraulic fluid source (14), which comprises a pump (18), the at least one conduit and the valve (16), when it is in is second state, defines a fluid circulation, in which the ejector arrangement (17) is provided, there being a connection (20) between the ejector arrangement and the working chamber (7), further comprising a valve (35) opening on exceeding of certain pressure on the pressure side is arranged in the connection (34) between the pressure side and suction side of the pump.

* * * * *